US005289745A

United States Patent [19]

Beardsley

[11] Patent Number: 5,289,745

[45] Date of Patent: Mar. 1, 1994

[54] SOCKET WRENCH EXTENSION WITH LOCK

[76] Inventor: Gilbert D. Beardsley, Rte. #3 Box 1, Wickliffe, Ky. 42087

[21] Appl. No.: 44,574

[22] Filed: Apr. 6, 1993

[51] Int. Cl.[5] ..... B25B 13/00

[52] U.S. Cl. ..... 81/177.2; 81/177.85

[58] Field of Search ..... 81/177.85, 177.2; 403/322, 325, 328, 361, 365, 368

[56] References Cited

U.S. PATENT DOCUMENTS

| | | | |
|---|---|---|---|
| 751,345 | 2/1904 | Saunders | 81/177.85 |
| 2,987,334 | 6/1961 | Wendling | 81/177.85 |
| 4,399,722 | 8/1983 | Sardo | 81/177.85 |
| 4,420,995 | 12/1983 | Roberts . | |
| 4,502,365 | 3/1985 | Hacker . | |
| 4,733,584 | 3/1988 | Karge | 81/177.85 |
| 4,770,073 | 9/1988 | Palm | 81/177.2 |
| 4,781,085 | 11/1988 | Fox, III . | |
| 4,817,476 | 4/1989 | Karge . | |
| 4,865,485 | 9/1989 | Finnefrock, Sr. . | |
| 4,938,107 | 7/1990 | Nickipuck | 403/365 |
| 4,962,682 | 10/1990 | Rose et al. . | |
| 5,038,643 | 8/1991 | Crumbley | 81/177.85 |
| 5,214,986 | 6/1993 | Roberts | 81/177.2 |

*Primary Examiner*—Robert C. Watson
*Attorney, Agent, or Firm*—Richard C. Litman

[57] ABSTRACT

A socket tool extension element includes a latching mechanism for automatically securing a socket to a driven stud on one end of the extension simultaneously with the attachment of a wrench drive stud to a socket portion at the opposite end of the extension. A captive latch ball projecting from an opening on one side face of the driven stud is constantly biased to the projected position by one end of a compression spring housed within a latching bore angularly disposed relative the longitudinal axis of the extension element. The other end of the compression spring constantly engages a bearing member which in turn biases against a lock pin slidably disposed within a bore axially extending from the socket portion to the driven stud of the extension element. In an at-rest condition and with a socket attached to the driven stud, the socket is manually attachable and removable from the driven stud and temporarily retained thereupon by the yieldably biased latch ball. Thereafter, upon the attachment of a wrench drive stud to the extension socket portion, the drive stud engages an end of the lock pin, causing its axial displacement to force the bearing member toward the captive latch ball and full compressing the helicies of the compression spring so as to preclude any inward deflection of the latch ball such that the attached socket is non-removably retained or locked upon the extension element as long as the wrench drive stud is connected thereto.

8 Claims, 3 Drawing Sheets

10
12
14
16
18
20
22
24
26
28
30
32
34
36
38
40
42
44
46
48
50
52
54
60
62
64
66
67
68
70
74

116
36
114
107
118
38
64
80
120
100
106
102
105
104
110
108
112

SOCKET WRENCH EXTENSION WITH LOCK

FIELD OF THE INVENTION

This invention relates generally to tools and more particularly, to an improved extension member for use with a wrench and socket and wherein the extension member includes a locking mechanism to deter unwanted separation of a socket from the extension member.

BACKGROUND OF THE INVENTION

No doubt one of the most frequently utilized tools of a mechanic, particularly an automotive mechanic, is the socket wrench. This tool comprises a wrench of any one of various types having a square drive element adapted to engage in a snap-fit manner, a square cavity as formed in any one of various sizes of socket elements, the latter destined to captively engage the polygonal periphery of either a nut or the head of a bolt/machine screw. When operating around larger pieces of equipment, such as motor vehicles and construction machinery, the need frequently exists to apply or remove threaded fasteners which are not readily accessible in view of cramped quarters immediately surrounding the fastener. In these cases, one applies an extension element intermediate the wrench and socket and which comprises an elongated element having a female upper end engaged by the wrench drive element and an opposite male end similar in configuration to the wrench drive element and which is snap-fitted into the socket.

A problem encountered when using many existing extensions with socket tool sets is that often when withdrawing the tool assembly from a use position, the socket is pulled from the lower end of the extension element due to an interference fit with the involved nut or bolt head. Thereafter, the socket may fall to an even more inaccessible spot or at least remain attached to the nut or bolt which is already in an awkward location. Thus, it will be highly desirable to have available an extension device for socket tools that automatically will provide a reliable locking action to positively retain sockets on its outer end yet will not call for an inordinate amount of machining or an excessive cost to manufacture. Many attempts at providing mechanisms in this area have been hampered by the extremely cramped space within which to install any supplemental structure. The most popular and often considered the standard size among socket tool sets is considered the ½" drive. This means that the square drive stud at the forward end of each extension is but one-half inch wide per face while the maximum diameter usually available throughout the length of the extension shank is approximately ⅝". Then, one must realize that a smaller, ⅜" drive socket tool set also exists and the available room within extensions in this latter size set will be even more restrictive. Thus, extension socket latching mechanisms must maximize use of the limited area available within the confines of elongated extension members and the instant construction proposes a unique solution in this area.

DESCRIPTION OF THE RELATED ART

Numerous lock/release devices for socket tools have been developed, with many specifically for use with socket tool extensions. Room remains for improvement in this area. Some prior designs have proven far too costly to produce in view of a complexity of components, while others have fallen short of providing a reliably positive locking action.

Examples of related existing socket locking devices will be found in the following described U.S. patents. U.S. Pat. No. 4,420,995 issued Dec. 20, 1983 to Roberts illustrates a socket locking mechanism comprising an axially displaceable, spring-biased member having a camming surface that is alternately shifted between positions allowing either movement of a ball detent or, preventing its movement. In this latter position, the ball detent is forced radially into a recess in a socket whereupon the socket is precluded from unintentional removal from the wrench stud. Not only is this example directed to the attachment of a socket to a wrench stud rather than an extension stud but no positive locking action is achieved with this arrangement as the socket may be forcefully withdrawn in a manner urging the ball detent to axially displace the spring-biased member.

Providing a manipulable control member for actuating socket latching means on a socket wrench extension per se will be found in U.S. Pat. Nos. 4,502,365 issued Mar. 5, 1985 to Hacker, 4,781,085 issued Nov. 1, 1988 to Fox III and 4,865,485 issued Sep. 12, 1989 to Finnefrock, Sr. Each teaches the use of a spring-biased element which is axially shifted between alternate positions to allow a ball detent to be released from a socket latching condition although none suggests the actuation of the latching mechanism automatically as a socket drive tool is connected to one end of the extension element.

Socket tool extension elements wherein a socket latching mechanism carried by the extension element is automatically actuated upon the application or removal of a wrench drive stud to one end of the extension element, will be found in U.S. Pat. Nos. 4,733,584 and 4,817,476 both issued to Karge, respectively on Mar. 29, 1988 and Apr. 4, 1989. These patents include an embodiment wherein a spring-urged axial pin within the extension element is displaced upon the application of a drive stud at one end and which jams a ball detent to bear into a socket dimple as carried at the other extension end. It is not seen as to how any yieldable catch means is provided in the above two patents since, upon removal of the drive stud from the extension, the biasing means has displaced the axial pin to a position fully clear of the ball detent, such that no retaining force is evident to maintain a socket on the other end of the extension, so long as a drive stud is not in place.

Another example of an extension provided with latch means securing a socket thereto will be found in U.S. Pat. No. 4,962,682 issued Oct. 16, 1990 to Rose et al., wherein a spring-urged actuator projecting from one side of an extension element must be manually depressed to permit retraction of a latch ball adapted to retain a socket. Again, no automatic latching of a socket in a positive manner upon attachment of a drive stud is shown in the Rose et al. patent.

SUMMARY OF THE INVENTION

By the present invention, an improved socket tool extension is provided and which includes a locking mechanism that is actuated automatically upon attachment of a socket drive tool stud to one extension end so as to positively latch a socket element to the other end of the extension. To allow adequate retention of a socket upon the extension, even when a socket drive tool is not connected thereto, a ball retention device comprising a plurality of balls and an intermediate compression spring, serves also as the latching device. This dual function occurs as initially, an axial pin seeks an at-rest position in the extension wherein a recess on the pin permits the expansion of the compression spring while still exerting a noticeable force upon a retention ball at the drive stud end of the extension. However, when a tool drive stud is connected at the other end of the extension, an end of the axial pin is simultaneously urged forwardly to urge the compression spring into full compression, thus stabilizing its two ends and precluding any displacement of a latching ball carried by one end of the spring and which is adapted to be contained within a dimple or the like in a tool socket. While in this secure mode, the latching ball will remain immobilized until such time as the drive tool stud is disconnected from the extension, at which time a biasing element acts to shift the axial pin and allow the inward deflection of the latching ball along with easy removal of any socket mounted upon the extension.

Maximum use is made of the limited area within a ½" drive extension or, even the smaller ⅜" size extension, by specifically locating the axis of the bore containing the latch pin, asymmetrically when viewing the extension from an end. By forming this bore off-center and diametrically opposite the location of the deflectable latch ball on the extension drive stud, it will be appreciated that the width of the drive stud is maximized. By forming the latching bore housing the compression spring, latch ball and bearing member at an oblique angle relative the longitudinal axis of the extension element, still greater space is provided to accommodate a compression spring of sufficient length to adequately function as described herein.

Accordingly, one of the objects of the present invention is to provide an improved automatically locking socket and extension element including a latching bore in a driven stud portion of the extension element and which houses a captive latch ball, compression spring and bearing member whereby upon attachment of a driving stud on a wrench, a latch pin biases the bearing member to fully compress the compression spring and preclude inward displacement of the latch ball as it maintains a socket locked to the extension element.

Another object of the present invention is to provide an improved automatically locking socket and extension element having a latch pin extending therethrough from a driving socket end to a driven stud end and which is disposed asymmetrically relative the center axis of the extension element.

A further object of the present invention is to provide an improved automatically locking socket and extension element including a longitudinally extending latch pin normally projecting into a driven socket end and which when axially displaced by attachment of a driving wrench stud, completely collapses all of the helicies of a compression spring in an angular latch bore to immobilize a latch ball projecting from a driven stud end of the extension element in order to lock a socket mounted thereupon.

Still another object of the present invention is to provide an improved automatically locking socket and extension element including a latching bore in a driven stud end of the extension element and which is oriented obliquely relative the longitudinal axis of the extension element.

With these and other objects in view which will more readily appear as the nature of the invention is better understood, the invention consists in the novel construction, combination and assembly of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figures 1, 2, 3:
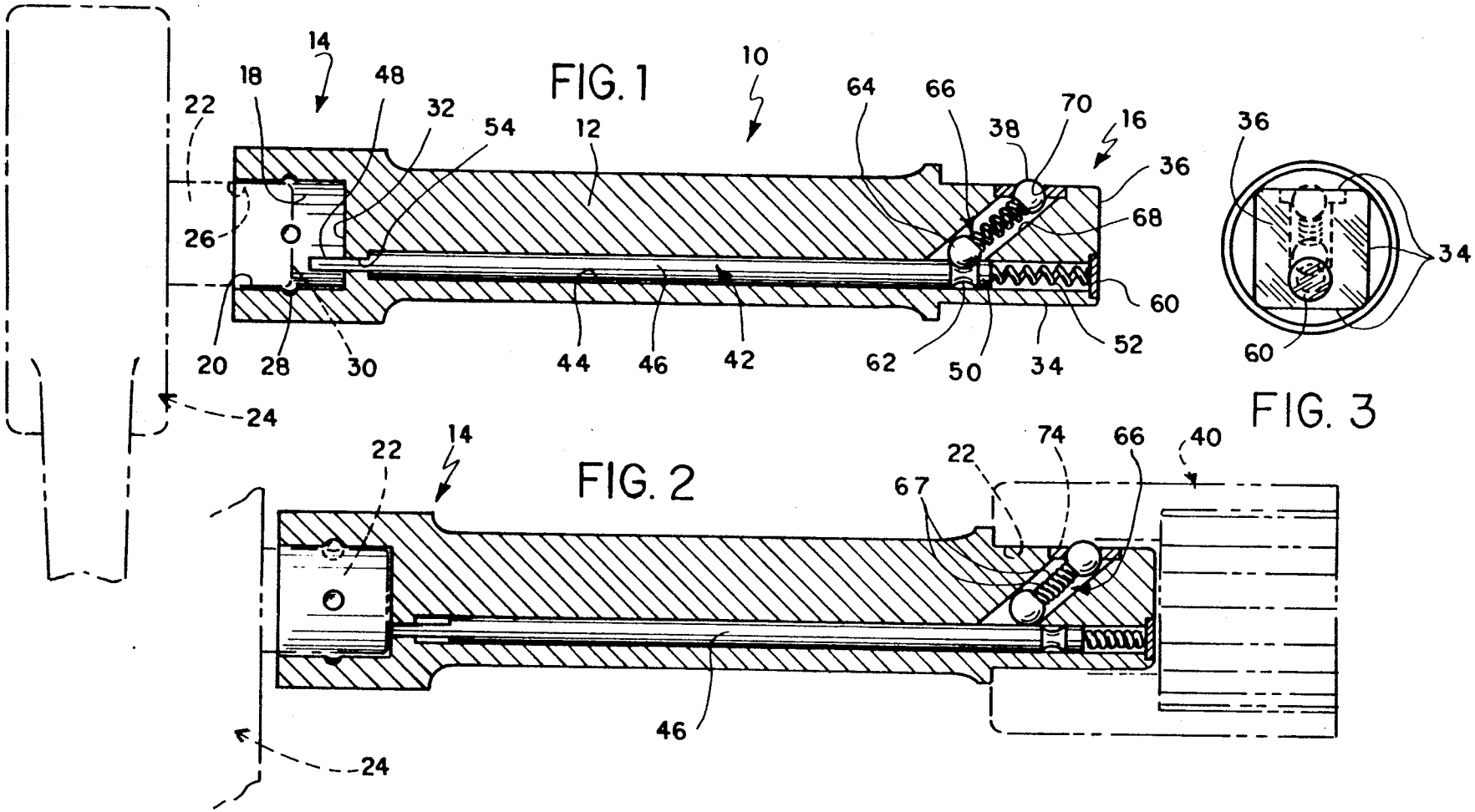
FIG. 1 is a side elevation, partly in cross-section, of an extension element according to the present invention.
FIG. 2 is a view similar to FIG. 1 and illustrates the extension element as it appears in the latched condition.
FIG. 3 is an end elevation of the device as shown in FIG. 1.

Referring now to the drawings, particularly FIGS. 1–3, the present invention will be seen to comprise a socket tool extension element, generally designated 10 and which includes an elongated shank 12 bounded at opposite ends by a wrench drive socket section 14 and socket driven stud 16. As known by those in the art, the overall length of existing extension tools may range from say, 3 inches, to 12 inches or even longer and the present extension will be understood to be applicable to any desired extension length. Outwardly, the drive socket section 14 and driven stud portion 16 are configured in a conventional manner so as to accommodate any standard square drive wrench tool and nut or bolt socket, respectively.

The drive socket section 14 includes the usual square cavity 18 defined by four congruent walls 20 and adapted to snugly receive a drive stud 22 from any well known type of socket wrench 24. The wrench 24 is conveniently releasably retained in an attached mode with the extension 10 by a spring-urged ball 26 carried by the drive stud 22 and which snap-fits into a cooperative fitting 28 in one or more of the socket section walls 20. Such fitting 28 is illustrated the inner end of a bore through the drive socket section 14 but may assume any of several other configurations such as a recess or dimple in the side wall 20. When a wrench drive stud 22 is fully seated in the cavity 18, its end face 30 will be understood to be immediately juxtaposed the bottom wall 32 of the cavity, a disposition that will affect the operation of the invention as will be seen hereinafter.

Figure 4:
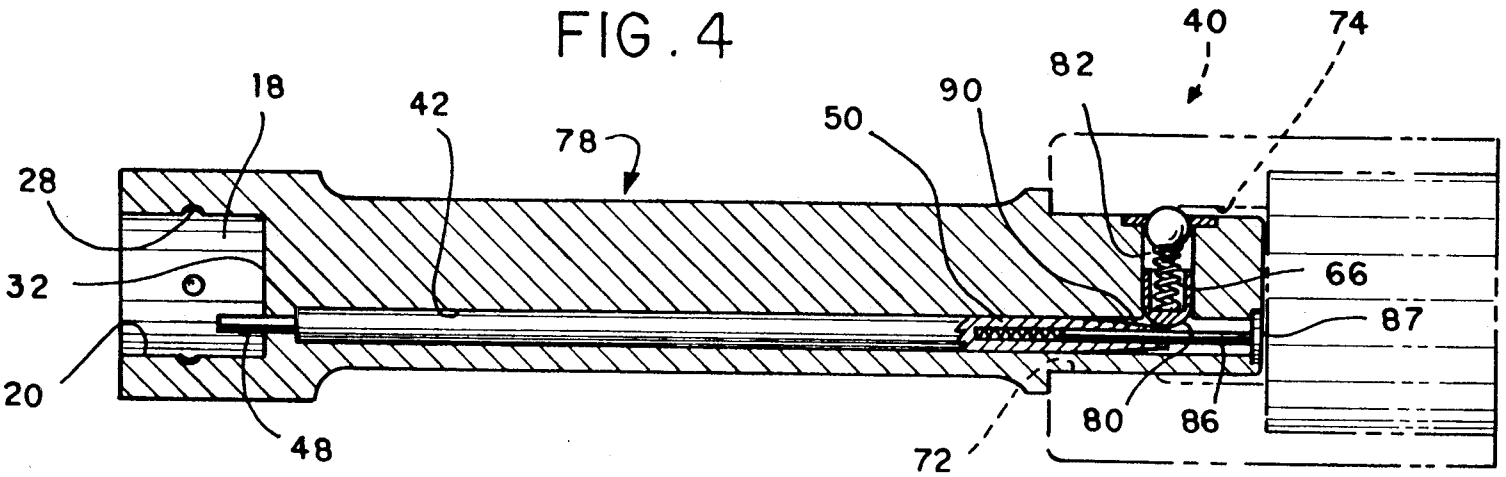
FIG. 4 is a side elevation, partly in cross-section, of another embodiment of the invention as it appears in the unlocked condition.

The driven or socket stud 16 at the far end of the extension element 10 is provided with the usual square configuration defined by four side walls 34 bounded by a square end face 36 and includes, on one wall 34, a normally outwardly projecting latch ball 38 which functions in a manner similar to the retention ball 26 as carried by the wrench drive stud 22, when a socket 40 as shown in FIG. 4 is snap-fitted upon the stud 16.

The above operations of attaching and retaining a wrench stud and socket to extension tools is well practiced. The instant invention provides an advancement by offering improved locking or latching means whereupon, with a mounted wrench and socket, an enhanced locking action is presented such that a mounted socket 40 is more positively secured to the extension 10 and remains thusly locked until the wrench 24 is removed therefrom.

To achieve the foregoing, a lock pin 42 is slidably positioned within a longitudinally disposed bore 44 extending from the extension end face 36 and through the drive stud cavity bottom wall 32. In the embodiment of FIGS. 1-3, the lock pin 42 comprises a main body 46 terminating in a first, drive or actuating end 48 and a second, locking end 50 located in the area of the socket driven stud 16. The pin 42 is adapted to be displaced between the unlocked and locked positions of FIGS. 1 and 2, respectively. In the former position, a compression pin spring 52 within the bore 42 constantly biases the pin in the direction of the drive socket section 14 such that the reduced diameter of the first end 48 of the pin is projected through a pilot bore 54 and into the socket cavity 18. The lock pin 42 is limited in this displacement upon the abutment of a pin shoulder 56 with a stop wall formed by the end of the larger bore 42.

The forward end of the pin spring 52 abuts any suitable stationary structure such as an end cap or plug 60 secured relative the extension end face 36. When in the normal, at-rest or unlocked position of FIG. 1, a ball receiving relief such as the cut-out or peripheral groove 62 formed in the second end 50 of the pin, comes into play to allow ready attachment and removal of a socket 40 to the extension driven stud 16. As shown most clearly in this drawing figure, a bearing element such as the illustrated spherical ball 64, is biased into the relief 62 by a latch compression spring 66 having its opposite end engageable with the latch ball 38. The two balls 64, 38 and the spring 66 are housed within a latch bore or passageway 68 which is angularly disposed relative the pin bore 42 and extends from the pin bore to the side wall 34 from which the latch ball 38 projects.

Figure 5:
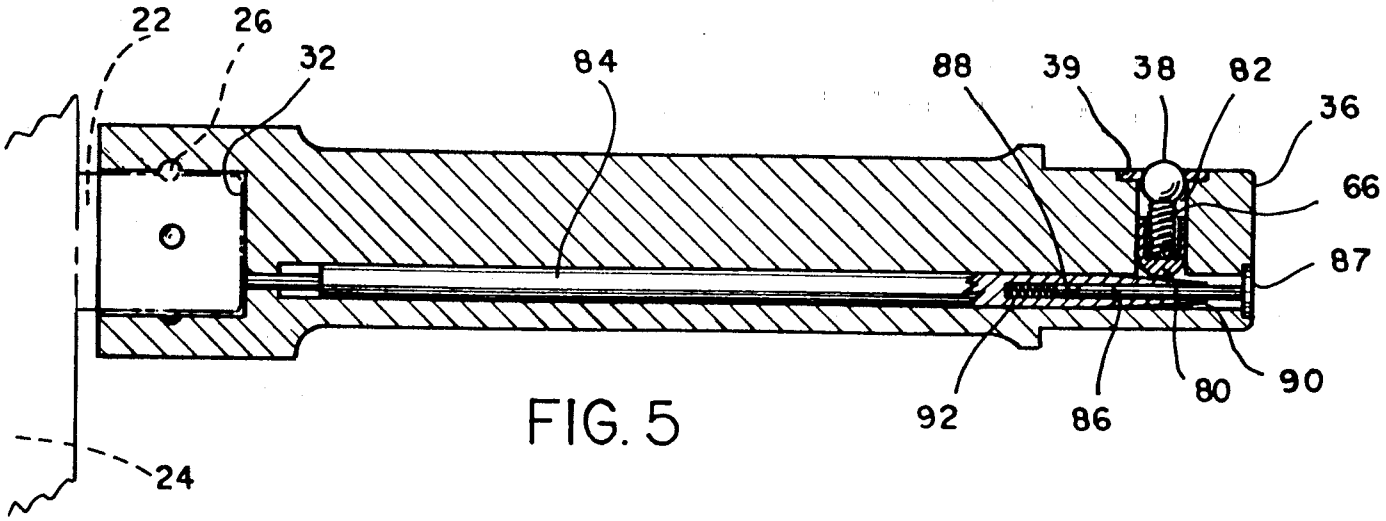
FIG. 5 is a view similar to FIG. 4 and illustrates the device in the latched condition.
Figure 6:
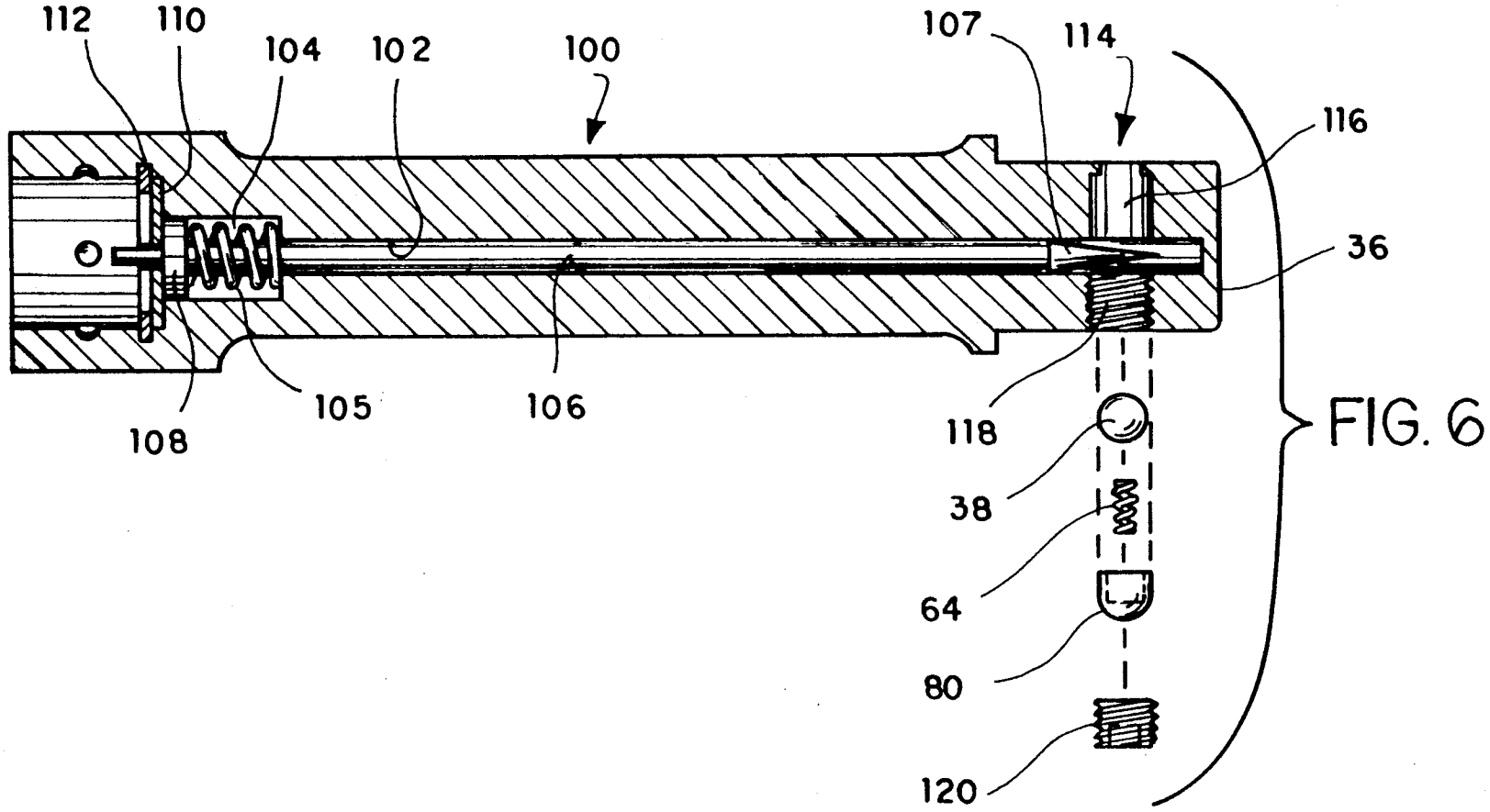
FIG. 6 is a partly exploded view, partly in cross-section, of a further embodiment.

The longitudinal axis of the bore 68 may be normal to the axis of latch bore 42 as in the embodiments of FIGS. 4-6 or obliquely thereto as in FIGS. 1 and 2. A decided advantage obtained with the oblique disposition is that the longitudinal extent of the latch bore 68 is noticeably increased. This permits the installation of larger diameter latch balls 38 and bearing elements 64 along with larger diameter and/or greater length springs 66, all of which contribute to a smoother more positively acting mechanism. The criticality of lateral space within the confines of an extension element is always of concern, even with extensions for ½ inch drive socket systems. With the smaller ⅜ inch systems, many existing socket latching mechanisms would be hard pressed to accommodate the necessary components within such confines.

The oblique disposition of the passageway 68 is but one feature of the instant mechanism that insures maximum utilization of the available space in the extensions. The described asymmetrical location of the longitudinal lock pin bore 42, juxtaposed a side wall 34 opposed to that occupied by the latch ball 38, will be understood to significantly increase the lateral space between the lock pin 42 and that stub side wall from which the latch ball 38 projects. Depending upon the size of extension element under consideration and the specific type of retention mechanism being employed within the latch passageway 68, neither, either or both the asymmetrical pin or oblique passageway may be practiced so that an optimal arrangement is obtained for the space at hand.

During use of the present apparatus, it will be appreciated that initially, the extension 10 must be removed from any wrench drive stud 22 in order to accomodate a socket 40 on the driven stud 16. When in this mode, as depicted in FIG. 1, the helicies 67 of the spring 66 are extended or spaced-apart as the spring yieldably biases the latch ball beyond the plane of the side wall opening 70 on the one end and, the bearing element or other ball 64 into the pin groove or recess 64. At any time when in this condition, the walls 72 defining the square cavity of a socket 40 may be slipped about the socket driven stud 16 of the extension. During this application, the resiliently projecting latch ball 38 is initially deflected by the socket wall 72 until the socket is fully installed upon the extension stud 16 at which point, the latch ball is spring-urged outwardly into a dimple, groove or other relief area 74.

When installed as above, a socket 40 is retained upon the forward end 16 of the extension solely by the force of the latch ball being biased into the relief area 74 of the socket. This force is usually adequate enough to fully retain the tool parts united during routine handling of the assembled tools prior to application to a nut or bolt and should one change their mind about the size socket being used, it is a simple matter to snap off one socket and snap-fit another to the extension stud 16.

When the preliminary operation as described above has been accomplished, the assembled extension and socket is readied to use in a locked mode by fully attaching a wrench driving stud 22 in the manner shown in FIG. 2 and wherein the end face 30 of the stud displaces the lock pin 42 forwardly, against the force of the compression spring 52. During this action, the bearing element or ball 64 is cammed outwardly from its seat 62 and maintained in the position of FIG. 3 by its engagement with the main body 46 of the lock pin 42. Important to note is that when in this locked condition, the helicies 67 of the ball compression spring 66 are fully compressed into a contiguous relationship so that the latch ball 38 becomes immobilized and accordingly, the socket 40 is positively locked upon the extension 10. Removal of the socket is readily achieved only following disconnection of the wrench stud 22 from the extension drive socket section 14 which allows the mechanism to return to the position shown in FIG. 1.

The embodiment shown in FIGS. 4-5 depicts a locking mechanism that functions in a manner similar to that as explained above. The most significant distinction is that the latch ball 38 is biased by a bearing element comprising a cup 80 within which one end of the lock compression spring 66 is nested. With this constuction, more room becomes allotted for the spring 66 and latch ball 38 since the lower area of the bearing cup 80 is substantially thinner than the diameter of the bearing ball 64 employed in the prior embodiment. Again, this bearing element may be used either with a housing or passageway 82 that is normal to the longitudinal axis of the extension element or, oblique, as in FIGS. 1 and 2.

Alternatively, the extension element 78 may be provided with the lock pin and spring of FIGS. 1-2 or, the modified lock pin and spring shown in FIGS. 4-5 and wherein the forward end of the pin 84 is provided with a guide member 86 slidably disposed within an inner bore 88 of the pin. This guide member not only stabilizes the tapered nose 90 of the pin against radial pressure from the bearing element 80 but also serves to provide a fixed abutment for one end of a lock pin compression spring 92. This spring 92 will be seen to be fully disposed within the pin bore 88 and thus constantly biases the pin towards the unlocked condition of FIG. 4.

An apertured latch ball plate 39 encloses the exterior of the housing 82 in this embodiment as well as the housing 68 in the first described variant and serves to retain the bearing elements within the respective housings while allowing but a portion of the periphery of a latch ball 38 to project therethrough. The plate 39 may be retained by an interference fit or by any other well known arrangement. The guide member 86 is suitably retained within the bore 42 and inner bore 88, such as by an integral head 87 which likewise may be press fitted within the end face 36 of the tool. The operation of this version is similar to that as set forth above, with the tapered nose 90 serving in a manner equivalent to the groove 62 of the pin 42.

The remaining embodiment shown in FIG. 6 includes an extension element 100 which again functions similarly to the previously described variants but may offer some advantages from the standpoint of machining and assembly operations. As will be seen, a bore 102 and counterbore 104 contain a lock pin 106 and axial spring 105. The pin 106 is limited in stroke by a stop collar 108 carried by the pin and which is constantly urged rearwardly as the spring 105 biases the collar 108 towards a washer 110 that is retained by a snap-ring 112. Again, either type of bearing element may be used to facilitate the assembly, but a transverse through bore 114 is provided and which includes a first section 116 for retaining the spring 64, latch ball 38 and cup 80 all on one side of the tapered point 107 at the leading end of the pin. A second threaded section 118 serves to close access to the first section following assembly of the components, as by the set screw 120.

From the foregoing, it will be appreciated that an improved extension element for socket tools is proposed and which employs a minimum number of components contained in easily machined bores and which function to insure a positive locking of a socket member to the extension in an automatic manner upon the attachment of a socket wrench thereto.

It is to be understood that the present invention is not limited to the embodiments described above, but encompasses any and all embodiments within the scope of the following claims.

I claim:

1. A socket wrench extension element comprising:

an elongated shank having a wrench drive section at one end and a socket drive stud at an opposite end, said socket drive stud having a plurality of side walls adapted to be engaged by a cavity of a tool socket, a latch ball projecting from an opening in one of said plurality of side walls and adapted to engage retention means in the cavity of a tool socket, a longitudinal bore in said extension element extending from said wrench drive section to said socket drive stud and containing a shiftable lock pin therein, said longitudinal bore and said lock pin aligned within said elongated shank asymmetrically of its center axis, an elongated passageway communicating between said bore and said latch ball and containing bearing means engageable with said lock pin, compression spring means in said passageway intermediate said latch ball and bearing means, deflection means on said lock pin engageable with said bearing means upon axial displacement of said lock pin to positions alternately compressing and partially relaxing said compression spring means to immobilize or permit displacement respectively of said latch ball, and means on said lock pin engageable upon attachment and removal of a wrench stud to said wrench drive section, to produce said axial displacement of said lock pin to said alternate positions to respectively lock or allow removal of a tool socket from said extension drive stud.

2. A socket wrench extension element according to claim 1 wherein, said elongated passageway is disposed obliquely to said lock pin.

3. A socket wrench extension element according to claim 1 wherein, said bearing means comprises a spherical ball.

4. A socket wrench extension element according to claim 1 wherein, said compression spring means comprises a wire spring defining a plurality of helicies.

5. A socket wrench extension element according to claim 1 wherein, said deflection means comprises a groove around said lock pin.

6. A socket wrench extension element according to claim 1 wherein, said lock pin means comprises an actuating end portion on said lock pin normally projecting into said wrench drive section.

7. A socket wrench extension element according to claim 4 wherein, said compression spring helicies are fully in abutment when said lock pin is displaced to said alternate lock position.

8. A socket wrench extension element according to claim 1 wherein, said longitudinal bore and said locking pin are disposed adjacent another one of said side walls and which is opposite said one of said plurality of side walls.

* * * * *